US005275226A

United States Patent [19]

Cook

[11] Patent Number: 5,275,226

[45] Date of Patent: * Jan. 4, 1994

[54] METHOD AND APPARATUS FOR CASTING

[75] Inventor: Arnold J. Cook, 372 N. Craig St., Pittsburgh, Pa. 15213

[73] Assignee: Arnold J. Cook, Pittsburgh, Pa.

[ * ] Notice: The portion of the term of this patent subsequent to May 12, 2009 has been disclaimed.

[21] Appl. No.: 871,532

[22] Filed: Apr. 21, 1992

Related U.S. Application Data

[63] Continuation of Ser. No. 607,847, Nov. 1, 1990, Pat. No. 5,111,871, which is a continuation of Ser. No. 325,221, Mar. 17, 1989, abandoned.

[51] Int. Cl.[5] ..... B22D 18/06; B22D 19/14

[52] U.S. Cl. ..... 164/63; 164/97; 164/119; 164/127; 164/254; 164/284; 164/337

[58] Field of Search ..... 164/63, 97, 119, 127, 164/254, 284, 337

[56] References Cited

U.S. PATENT DOCUMENTS

| | | | |
|---|---|---|---|
| 3,532,154 | 10/1970 | Balevski et al. | 164/337 X |
| 3,599,601 | 8/1971 | Ishikawa et al. | 164/61 X |
| 3,828,839 | 8/1974 | Dhingra | 164/97 |
| 4,476,916 | 10/1984 | Nusbaum | 164/97 X |
| 4,573,517 | 3/1986 | Booth et al. | 164/61 |
| 4,763,717 | 8/1988 | Lajoye | 164/258 |
| 4,889,177 | 12/1989 | Charbonnier et al. | 164/119 X |
| 5,111,871 | 5/1992 | Cook | 164/63 |

FOREIGN PATENT DOCUMENTS

| | | | |
|---|---|---|---|
| 58-32564 | 2/1983 | Japan | 164/63 |
| 59-54458 | 3/1984 | Japan | 164/63 |
| 60-154861 | 8/1985 | Japan | 164/63 |
| 62-114762 | 5/1987 | Japan | 164/61 |
| 63-235044 | 9/1988 | Japan | 164/255 |
| 980951 | 12/1982 | U.S.S.R. | 164/61 |

OTHER PUBLICATIONS

"Wetting, Fluidity and Solidification in Metal Matrix Composite Castings: A Research Summary", Cornie, J. A., Mortensen, A. and Flemings, M. C., Department of Materials Science and Engineering, MIT, 1987.

"An Apparatus for Pressure Casting of Fibre-Reinforced High-Temperature Metal-Matrix Composites", Nourbakhsh, S., Lang F. L. and Margolin, H., J. Phys. Sci. Instrument, 21, 1988, received Mar. 28, 1988.

"Processing of Metal and Ceramic Matrix Composites", Cornie, J.A., Chiang, Y. M., Uhiman, D., Mortensen A., Collins, J. M., Bulletin of the American Society, vol. 65, Feb. 1986, pp. 293-304.

"On the Infiltration of Metal Matrix Composites" Mortensen, A., Cornie, J. A., Metallurgical Transactions A. Jun. 1987, pp. 1160-1163.

(List continued on next page.)

*Primary Examiner*—J. Reed Batten, Jr.
*Attorney, Agent, or Firm*—Ansel M. Schwartz

[57] ABSTRACT

A porous preform is placed in a nonporous mold chamber of a pressure vessel. A material is placed in a crucible of the pressure vessel. The pressure vessel is evacuated through a snorkel fluidically connected to the mold chamber and extending therefrom out of the pressure vessel. The material in the crucible is melted. The crucible is placed in fluidic communication with the mold chamber such that the melted material fluidically seals the inside of the mold chamber and the snorkel from the interior of the pressure vessel to fluidically isolate the mold chamber from the interior of the pressure vessel so that a pressure differential exists therebetween. Then, the vessel is pressurized while the mold chamber is continuously evacuated such that the melted material is drawn into the mold chamber and into the snorkel where a cooling element in thermal communication with the snorkel cools the melted material within the snorkel thereby forming a solidification plug and the material is forced into the porous preform and the material in the mold chamber is directionally solidified from the solidification plug.

7 Claims, 7 Drawing Sheets

OTHER PUBLICATIONS

"Columnar Dendritic Solidifaction in a Metal-Matrix Composite", Mortensen, A., Cornie, J. A., Flemings, M. C., Metallurgical Transactions A, vol. 19A, Mar. 1988, pp. 709-721.

"Fundamental Aspects of Solidification Processing of Metal Matrix Composites by Pressure Infiltration Techniques", Cornie, J. A., and Mortensen, A. The 2nd International New Materials Conference & Exhibition, Japan, Oct. 1988.

"Infiltration of Fibrous Preforms by a Pure Metal", Masur, L. J., submitted to the Dept. of Materials Science and Engineering at the Massachusetts Institute of Technology, 1988.

"The Squeeze Infiltration Process for Fabrication of Metal-Matrix Composites" Clyne, T. W., Mason, J. F., Metallurgical Transactions A, vol. 18A, Aug. 1987, pp. 1519-1530.

"Silicon Carbide Reinforced Aluminum-A Formable Composite", Divecha, A. P., Fishman, S. G., Karmarkar, S. D., Journal of Metals, vol. 33, Sep. 1981.

"The Production-Scale Squeeze Casting of Devitroceramic Fiber Reinforced Aluminum and its Mechanical Properties", Fukunaga, H., Komatsu, S., Kanoh, Y., Bulletin of the JSME, vol. 26, Oct. 1983.

"Analysis of a Squeeze-Infiltration Process For Fabrication of Metal Matrix Composites", Clyne, T. W., Bader, M. G., Proceeding of the Fifth International Conference on Metal Matrix Composites, 1985, pp. 755-771.

"The Solidification Process During Pressure Casting SiC and $Al_2O_3$ Reinforced Al-4.5% Cu Metal Matrix Composites", Cornie, J. A., Mortensen, A., Gungor, M. N., Flemings, M. C., Proceedings of the Fifth International Conference on Composite Materials, San Diego, Calif. 1985, pp. 809-823.

METHOD AND APPARATUS FOR CASTING

This is a continuation of U.S. patent application Ser. No. 07/607,847 filed Nov. 1, 1990, now U.S. Pat. No. 5,111,871 which is a continuation of U.S. patent application Ser. No. 07/325,221 filed Mar. 17, 1989, now abandoned.

FIELD OF THE INVENTION

The present invention is related to an apparatus for casting. More specifically, the present invention is related to an apparatus and method for producing fiber reinforced materials.

BACKGROUND OF THE INVENTION

Fiber reinforced materials, where the material is commonly a metal, provide a level of strength to a structure that otherwise cannot be attained with just the material itself. The fibers in the material increase the stiffness of the material such that for a given applied load, the material deflects less than an unreinforced material. In order to produce fiber reinforced materials, the fibers are typically bundled together in some fashion and form corresponding to the ultimate devised shape of the fiber reinforced material. Then the material must somehow be forced into the fiber bundle so it completely fills the interstices of the fiber bundle. This is normally accomplished by liquifying the material and then forcing it into the fiber bundle. U.S. Pat. No. 4,573,517 to Booth, et al. discloses an apparatus and method for forcing melted metal into a fiber bundle. It requires the apparatus wherein this method is performed to first be evacuated through a furnace thereof. Then melted metal is forced into a fiber bundle under pressure of gas pumped into the vessel. However, this technique requires, as do all other techniques heretofore known, that the chamber within which the production of the fiber reinforced material occurs be strong enough to withstand the necessary pressures so it does not explode apart either from the inside or the outside. Additionally, in the patent to Booth, the level of melted metal within the structure must be carefully controlled or cooling thereto causes it to solidify making the process useless.

An apparatus is disclosed by Masur, L. J., Mortensen, A., Cornie, J. A. and Flemings, M. C.; "Pressure Casting of Fiber-Reinforced Metals" *Proceedings of the Sixth International Conference on Composite Materials* ICCM-VI, F. L. Matthews, N. L. R. Bushell, and J. M. Hodginson, Eds. London, 1987, Elsevier Applied Science, pp. 2.320–2.329 wherein a furnace is disposed inside a pressure vessel and pressure alone is used to fill a fiber preform with melted material. However, since this apparatus is for the purpose of determining the pressure necessary to penetrate a fiber preform, usable products therefrom are questionable.

The present invention requires only that a pressure vessel be strong enough to withstand the necessary pressures inside the vessel. As a result, a mold chamber holding a fiber array preform inside the vessel is subject only to small pressure differences, thus allowing much thinner or low strength mold chamber structures. This enables the present invention to be easier to use and quicker to use and enables a more uniform heating of the mold chamber with a single furnace design. Moreover, the level of melted material is not of great concern as long as it fills the mold chamber since cooling of the melted material is actually used for the benefit of the process as opposed to a detriment of the process.

SUMMARY OF THE INVENTION

The present invention pertains to an apparatus for casting. The apparatus is comprised of a pressure vessel and means for evacuating and pressurizing the vessel. The evacuating and pressurizing means is in fluidic connection with the vessel. The apparatus is also comprised of a crucible disposed in the pressure vessel within which material is melted. There is a mold chamber disposed in the pressure vessel within which a preform is held. Additionally, the apparatus is comprised of means for heating material in the crucible and the preform in the mold chamber such that material is melted in the crucible and stays melted as it is drawn up to the mold chamber while the evacuating and pressurizing means evacuates the vessel, and when it is forced into the preform while the evacuating and pressurizing means charges the vessel. The heating means is disposed in the vessel.

In a preferred embodiment, the evacuating and pressurizing means includes means for evacuating the vessel and means for pressurizing the vessel. The evacuating means is fluidically connected to the mold chamber through the vessel, and the pressurizing means is fluidically connected to the vessel. Additionally, the mold chamber includes a feeder tube fluidically connected thereto and extending out therefrom. The feeder tube is disposed in the vessel. Additionally, the apparatus preferably includes a crucible lifter connected to the crucible for lifting the crucible such that it is in fluidic connection with the feeder tube that extends from the mold chamber.

In a more preferred embodiment, a pressurizing means includes means for controlling the rate at which pressurization occurs such that the pressure in the mold chamber is able to have time to be driven toward instantaneous equilibrium with the vessel pressure.

The present invention also pertains to a method for casting. The method comprises the steps of placing in a mold chamber of a pressure vessel preform, placing in a crucible of the pressure vessel a material; evacuating the vacuum vessel through the mold chamber; melting the material in the crucible; placing the crucible in fluidic connection with the mold chamber; and pressurizing the vessel while it is continually evacuated such that the melted material is drawn into the mold chamber and forced into the preform.

The present invention is a method for casting. The method has the step of placing a porous preform in a nonporous mold chamber of a pressure vessel. Then, there is the step of placing a material in a crucible of the pressure vessel. Next, there is the step of evacuating the pressure vessel through a snorkel fluidically connected the mold chamber and extending therefrom out of the pressure vessel. Then, there is the step of melting the material in the crucible. Next, there is the step of placing the crucible in fluidic communication with the mold chamber such that the melted material fluidically seals the inside of the mold chamber and the snorkel from the interior of the pressure vessel to fluidically isolate the mold chamber from the interior of the pressure vessel so that a pressure differential exists therebetween. Then, there is the step of pressurizing the vessel while the mold chamber is continuously evacuated such that the melted material is drawn into the mold chamber and into the snorkel where solidifying means in thermal communication with the snorkel cools the melted material within the snorkel thereby forming a solidification plug and the material is forced into the porous preform and the material in the mold chamber is directionally solidified from the solidification plug.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
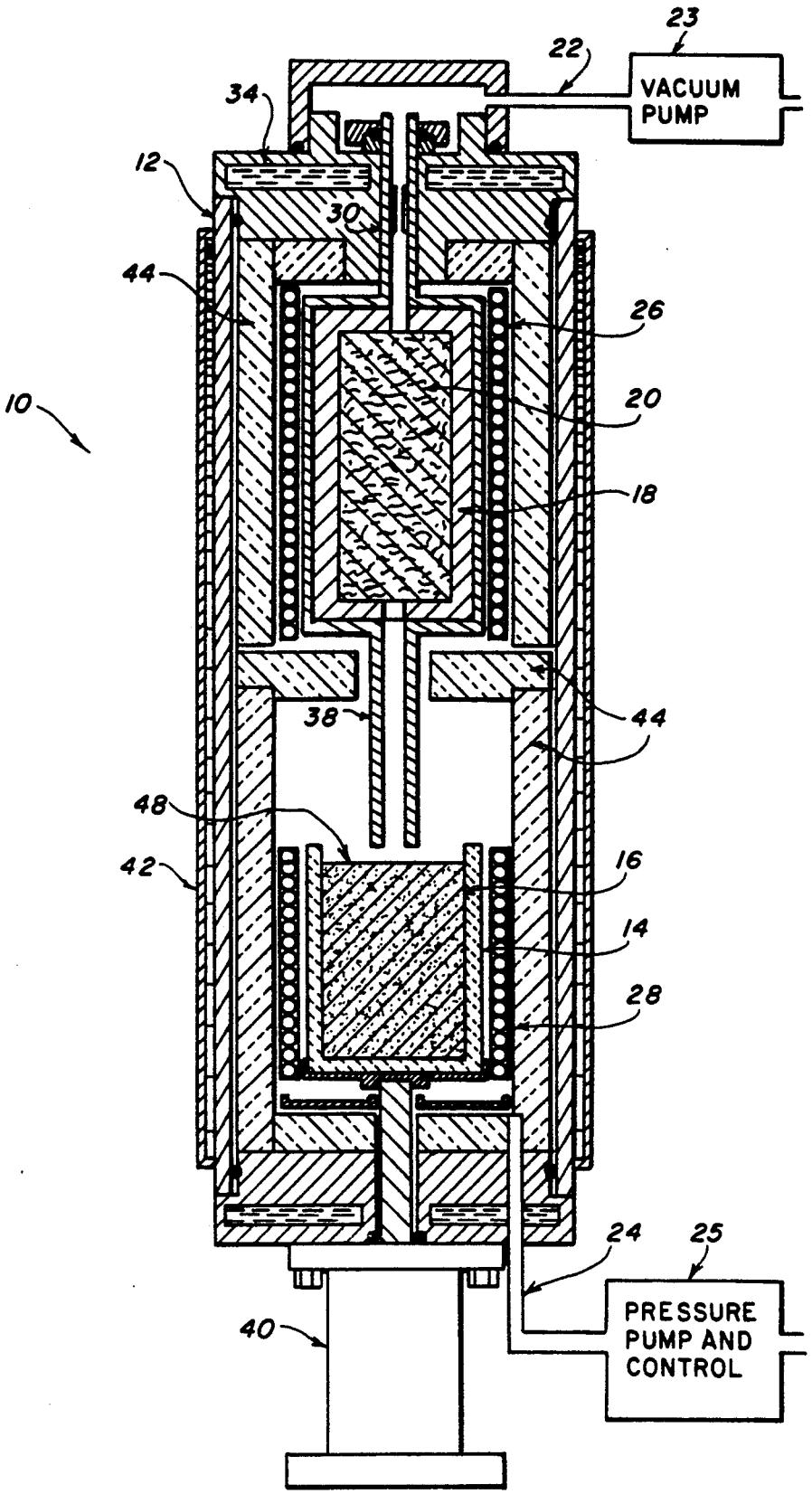
FIG. 1 is a cross-sectional schematic view of an apparatus for casting.

Referring now to the drawings wherein like reference numerals refer to similar or identical parts throughout the several views and more specifically to FIG. 1 thereof, there is shown a cross-sectional schematic view of an apparatus 10 for casting. The apparatus 10 comprises a pressure vessel 12 and means for evacuating and pressurizing the vessel 12. The vessel 12 is preferably made of 316 stainless steel. The evacuating and pressurizing means is in fluidic connection with the vessel 12. The apparatus 10 is also comprised of a crucible 14 disposed in the pressure vessel 12 within which material 16, such as aluminum, is melted. There is a mold chamber 18 disposed in the pressure vessel 12 within which a fiber array preform 20 is held although the invention is not in any way limited to fiber array preforms. The mold chamber 18 is preferably made of 304 stainless steel however, other materials can also be used and the crucible 14 is preferably graphite. The fibers used are preferably made of silicon carbide. When the mold chamber 18 is in fluidic connection with the crucible 14, melted material 16 in the crucible 14 can be drawn into the mold chamber 18 as the evacuating and the pressurizing means pressurizes the vessel 12. Typical pressures for use with silicon carbide fibers, and melted aluminum are 1000 PSI-2000 PSI and preferably 1300 PSI-1500 PSI. The pressure required is related to the volume fraction of fibers. In general, the more fibers per given unit of volume, the greater pressure is required to force the melted material between the fibers.

The apparatus is also comprised of means for heating material 16 in the crucible 14 and the fiber array preform 20 in the mold chamber 8 such that material 16 is melted in the crucible 14 and stays melted as it is drawn up to the mold chamber 18 while the evacuating and pressurizing means evacuates the vessel 12, and when it is forced into the fiber array preform 20 while the evacuating and pressurizing means pressurizes the vessel 12. The heating means is preferably disposed in the vessel 12. The heating means should provide enough heat to maintain the material in a melted state. For instance, with aluminum, the temperature should be over 600° C. and preferably between 650° C. and 700° C.

Preferably, the evacuating and charging means includes means 22 for evacuating the vessel and means 24 for pressurizing the vessel, such as a vacuum pump 23 and a pressure pump 25, respectively. The evacuating means 22 is fluidically connected to the mold chamber 18 in the vessel 12 and the pressurizing means is fluidically connected to the vessel 12. The heating means preferably includes a mold furnace 26 for heating the mold chamber 18 and a crucible furnace 28 for heating the crucible 14. The mold furnace 26 is preferably positioned about the mold chamber 18 and the crucible furnace 28 is preferably positioned about the crucible 14 to provide essentially uniform heating to the mold chamber 18 and crucible 14, respectively. It should be noted however that the mold furnace 26 is not necessary for the effective operation of the apparatus.

The evacuating means 22 preferably includes a snorkel 30 fluidically connected to the mold chamber 18 and extending therefrom out of the vessel 12. The evacuating means 22 also preferably includes means for solidifying the melted material 16 and the snorkel 30 to form a solidification plug when the melted material 16 is drawn therein. Preferably, the solidifying means includes a water cooled head 34 in thermal communication with the snorkel 30. In such an embodiment, the melted material solidifies to form the solidification plug as it moves adjacent the head 34. The head 34 can then be used, as above, to start a directional solidification down the mold such that, for instance, metal shrinkage during the solidification can be fed with additional metal from the crucible.

The mold chamber 18 preferably includes a feeder tube 38 fluidically connected thereto and extending out therefrom. The feeder tube is disposed in the vessel 12. The crucible 14 is fluidically connected to the mold chamber 18 through the feeder tube 38 such that melted material 16 in the crucible 14 can be drawn to the mold chamber 18 as the vacuum pump 23 evacuates the vessel 12 and the mold chamber 18 interior is fluidically isolated from direct communication with the vessel 12 interior. Note the pressure pump can also be used to aid in filling the mold chamber 18 with melted material 16 by pressurizing the vessel 12 and forcing the melted material 16 in the crucible 14 into the mold chamber 18.

Figure 13:
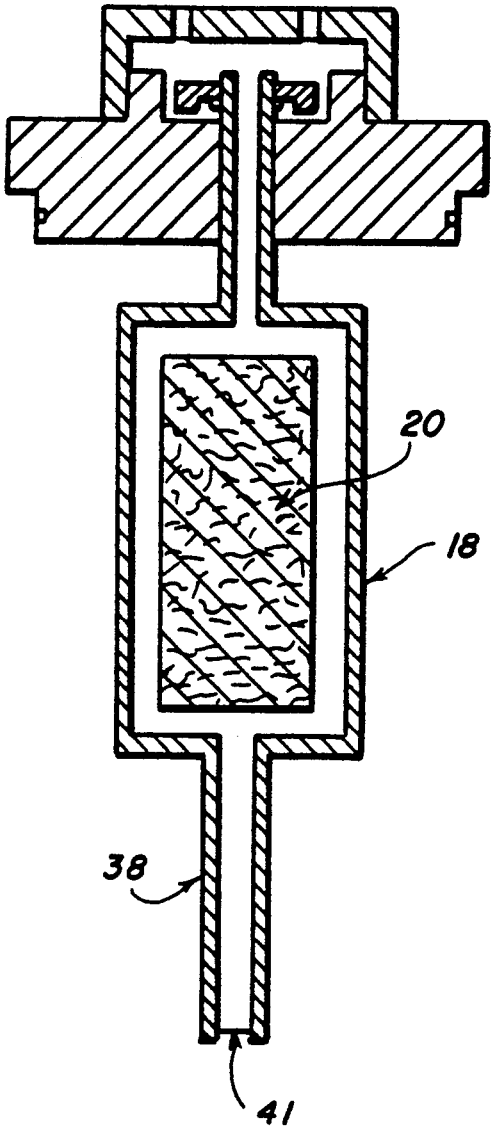
FIG. 13 is a partial cross-sectional side view of the apparatus for casting wherein a foil seal is in place over the fill tube.

In an alternative embodiment, fiber array preforms 20 can also be heated and evacuated prior to insertion in the vessel with the use of a foil seal 41 disposed at the bottom of the feeder tube 38, as shown in FIG. 13. The foil seal 41 is, for instance, made out of the same material 16 as the material 16 in the crucible 14. The foil seal 41 melts when placed in the crucible 14 filled with melted material 16, thus fluidically isolating the interior of the mold chamber 18 from direct communication with the interior of the vessel and allowing material 16 to move into the feeder tube 38. In such an embodiment, the material can be melted subsequent to insertion of the feeder tube 38 therein, thus eliminating the need for any furnaces or a crucible lifter 40.

Figure 2:
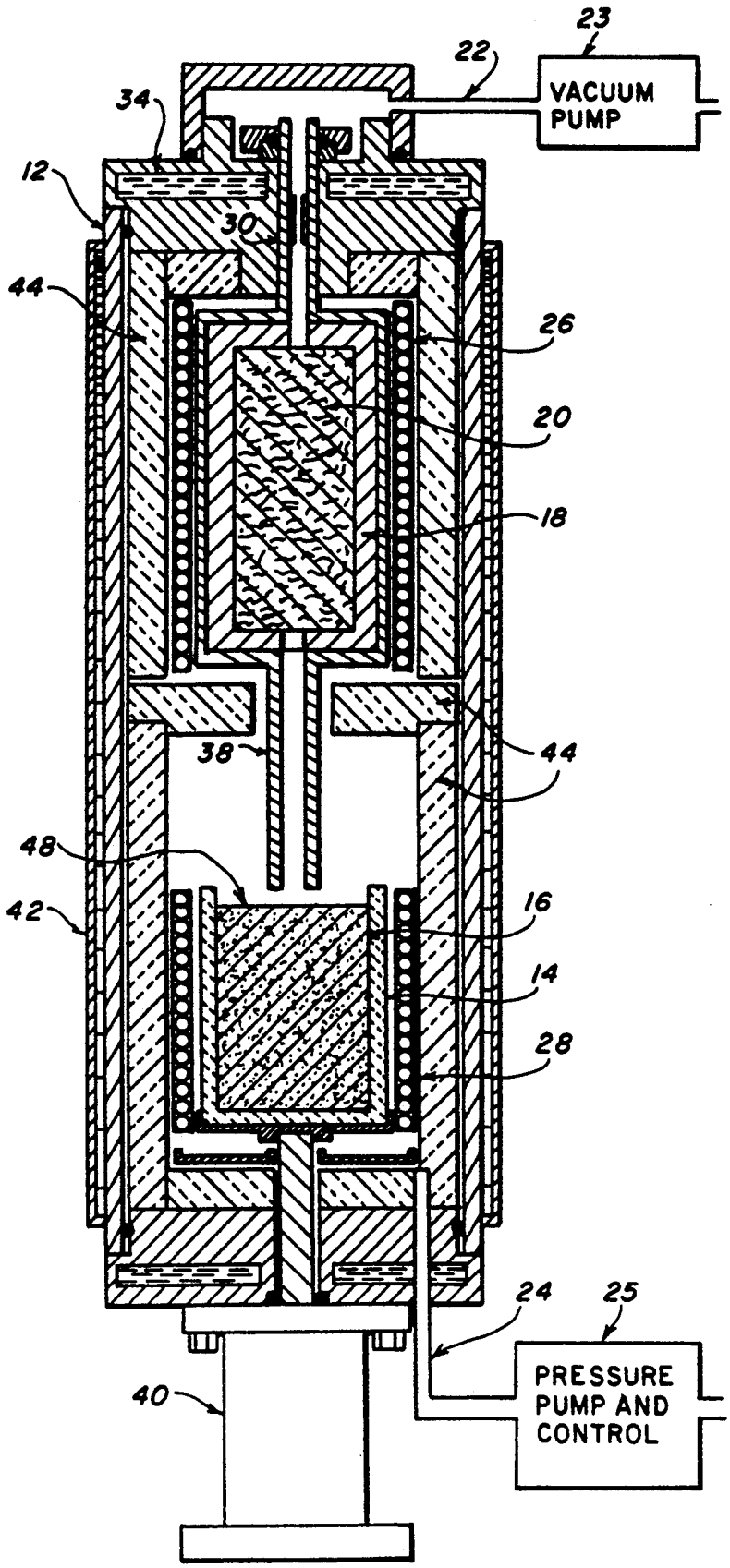
FIG. 2 is a cross-sectional side view of an apparatus for casting having a crucible in a first position.
Figure 3:
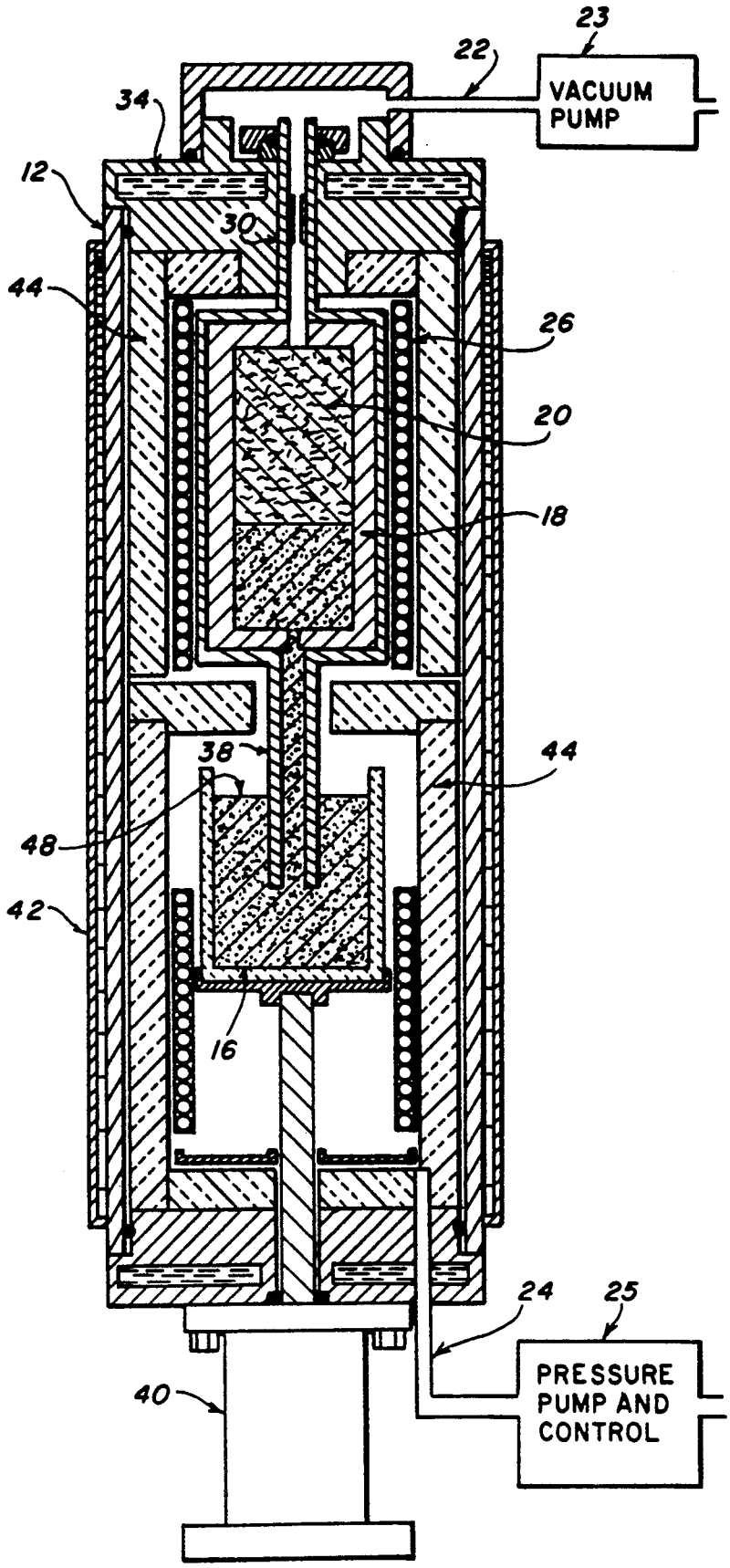
FIG. 3 is a cross-sectional schematic view of an apparatus for casting wherein the crucible is in fluidic connection with a mold chamber.

Preferably, the apparatus 10 includes a crucible lifter 40 connected to the crucible 14 for lifting the crucible 14 such that it is placed in fluidic connection with the feeder tube 38 that extends from the mold chamber 18, as shown in FIGS. 2 and 3. FIGS. 2 and 3 are cross-sectional schematic views of an apparatus 10 with the crucible 12 out of fluidic connection with the feeder tube 38, and in fluidic connection with the feeder tube 38 after the crucible lifter 40 has lifted the crucible 14, respectively. (Note FIGS. 1, 2 and 3 are drawn to scale so that the relationship of the various elements and structures thereof are defined regardless of the actual size chosen therefore.)

The apparatus 10 preferably is water cooled, for instance, with pipes 42 positioned about the vessel 12. The apparatus 10 also preferably includes insulation 44 disposed in the vessel 12 and positioned about the mold furnace 26 and the crucible furnace 28 for maintaining heat therein.

Figure 7:
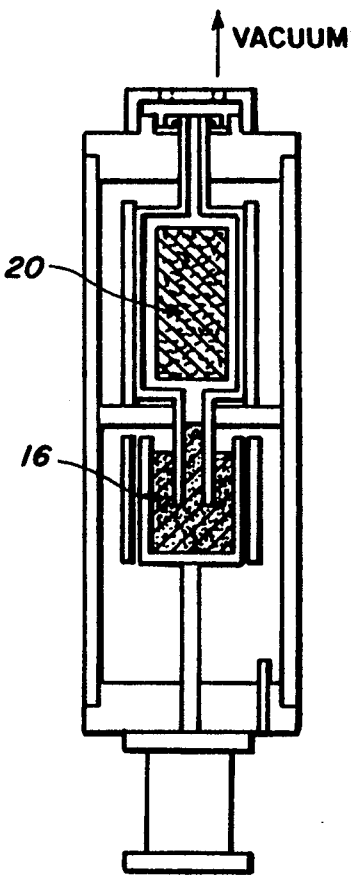
FIG. 7 is a cross-sectional schematic view of the apparatus for casting wherein the melted material in the crucible is being drawn into the mold chamber.
Figure 6:
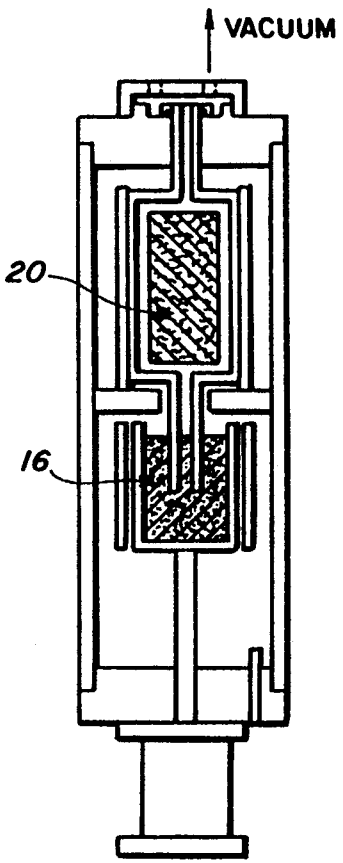
FIG. 6 is a cross-sectional schematic view of the apparatus for casting wherein the crucible is placed in fluidic communication with the mold chamber isolating the mold chamber from the vessel interior.
Figure 5:
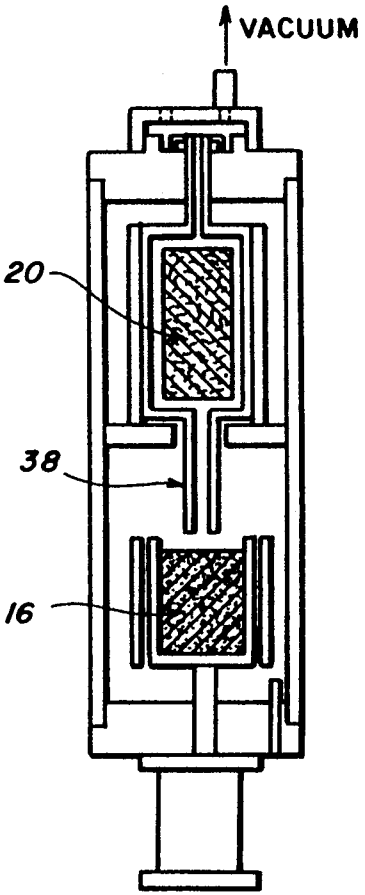
FIG. 5 is a cross-sectional schematic view of the apparatus for casting wherein material in the crucible is melted in a vessel wherein the mold and vessel is evacuated through the mold.
Figure 4:
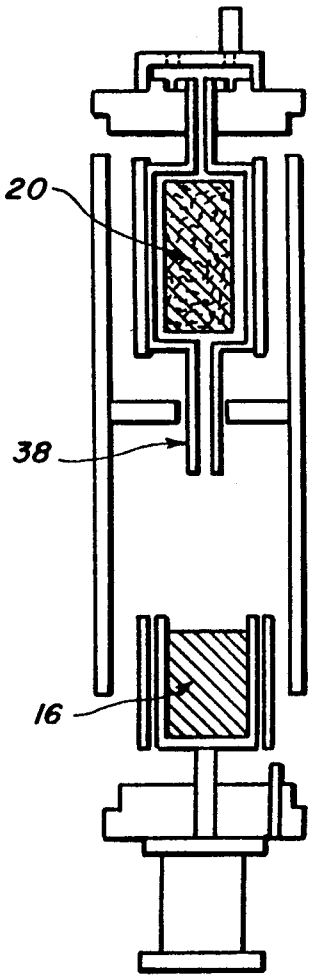
FIG. 4 is a cross-sectional schematic representation of an apparatus for casting being loaded.
Figures 8, 9, 10, 11:
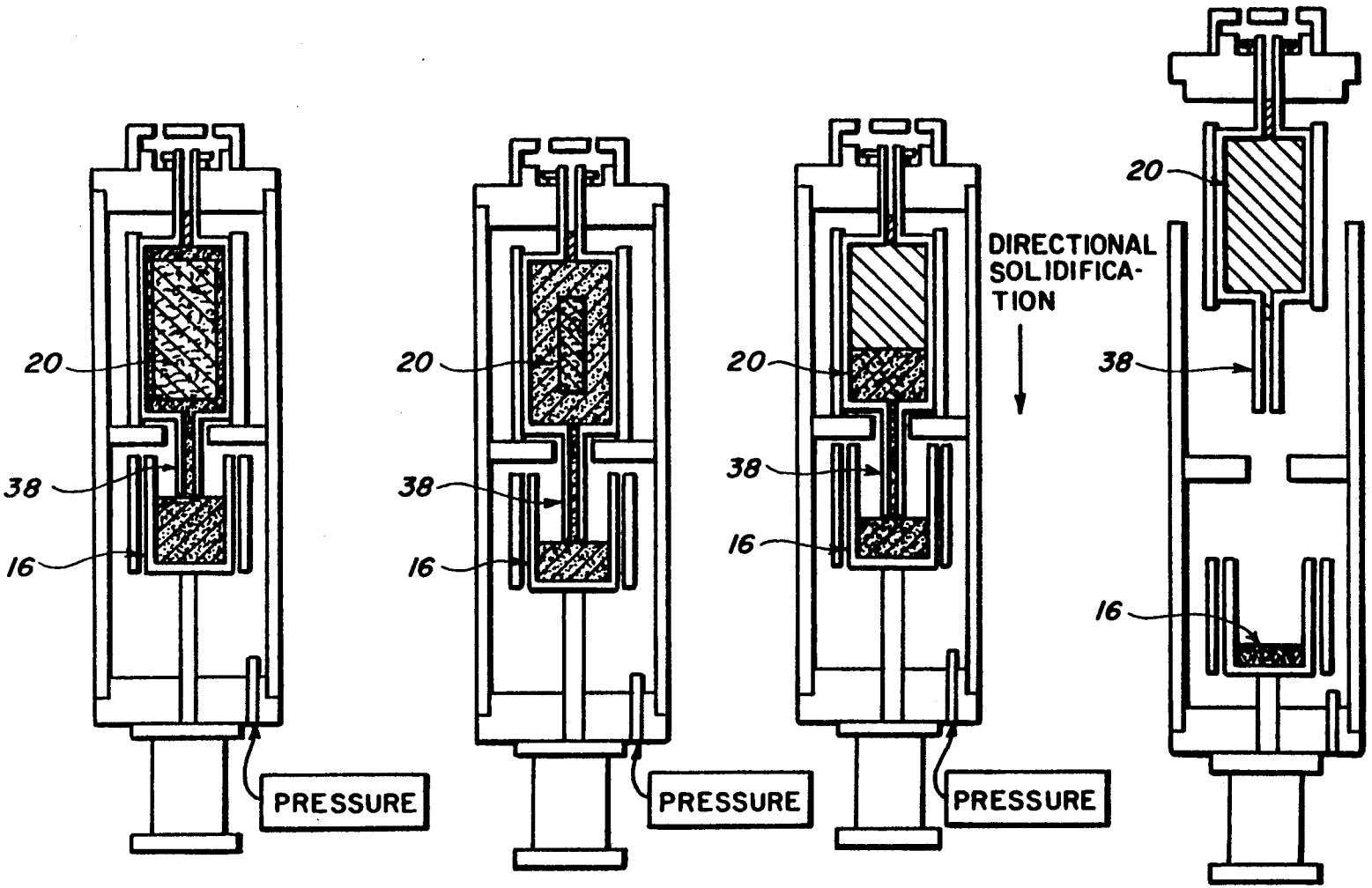
FIG. 8 is a cross-sectional schematic view of the apparatus for casting wherein a solidification plug is formed.
FIG. 9 is a cross-sectional schematic view of the apparatus for casting wherein controlled increasing pressure is provided to the vessel to force the melted material into the preform.
FIG. 10 is a cross-sectional schematic view of the apparatus for casting wherein the melted material is undergoing directional solidification.
FIG. 11 is a cross-sectional schematic view of the apparatus for casting being unloaded.

The present invention also pertains to a method for producing a fiber reinforced material. The method comprises the steps of placing in the mold chamber 18 of the pressure vessel 12 the fiber array preform 20. Then the step of placing in the crucible 14 of the pressure vessel 12 the material 16, as shown in FIG. 4, is performed. Next, the step of evacuating the pressure vessel 12 through the mold chamber 18, and melting the material 16 in the crucible 14, as shown in FIG. 5, is performed. Then the step of placing the crucible 14 in fluidic communication with the mold chamber 18, as shown in FIG. 6, is performed. Next, the step of pressurizing the vessel 12 while it is continually evacuated such that the melted material 16 is drawn into the mold chamber 18 and forced into the fiber array preform 20, as shown in FIGS. 7 and 8, is performed. The pressurizing step preferably includes the step of controlling the rate at which pressurization of the vessel 12 occurs such that the pressure in the mold chamber 18 is able to have time to be driven toward instantaneous equilibrium with the pressure in the vessel 12.

Preferably, before the pressurizing step, there is included the step of forming a solidification plug such that further evacuation is prevented from the pressure vessel 12, as shown in FIG. 8, and the melted material is prevented from leaving the vessel 12 via the snorkel 30. After the solidification plug forms, the continuous pressurizing from the pressure pump 25 of the vessel 12 forces the melted material 16 through the feeder tube 38 into the mold chamber 18. This continuous pressure causes the melted material 16 to penetrate into the fiber array preform 20 and eventually fill the fiber array preform 20, as shown in FIGS. 9 and 10.

The fact that the mold chamber 18 and crucible 14 are disposed inside the vessel 12 as are the mold furnace 26 and crucible furnace 28 requires that only the pressure vessel 12 be strong enough to withstand the internal forces that build up under the pressure from the pressure pump 25. But since the pressure in the pressure vessel 12 is uniform essentially throughout, by controlling the pressurization rate of the vessel such that the pressure in the mold chamber is able to have time to be driven toward instantaneous equilibrium with the vessel pressure, only a small differential pressure between the interior of the mold chamber 18 and the interior of the pressure vessel 12 exists at any give moment. Consequently, strength concerns of the mold chamber structure and mold seals are minimized. This small pressure differential between the interior of the mold chamber 18 and the interior of the pressure vessel 12 is kept to a minimum due to the action of the melted material 16 being forced into the mold chamber 18 by the pressure pump 25 in an amount corresponding to the pressure on the melted material 16.

Once the fiber array preform 20 is saturated with melted material 16, the temperature of the mold chamber 18 is lowered to allow the melted material 16 to solidify. Then pressure is released and the preform 20 is removed from the pressure vessel 12.

In the operation of the preferred embodiment, the crucible 14 is loaded with aluminum and placed in the vessel 12 which is then sealed, as shown in FIG. 4, with high temperature VITON® seals. The crucible furnace 28 and mold furnace 26 are then activated to melt the aluminum in the crucible 14. At the same time, the vacuum pump 23 is activated which evacuates the vessel 12 through the mold chamber 18, as shown in FIG. 5. As can be more clearly realized with respect to FIG. 1, the vacuum pump 23 evacuates the pressure vessel 12 through the mold chamber 18 by drawing fluid present in the vessel 12 first through the feeder tube and then through the mold chamber 18 and then through the snorkel 30. By evacuating the preform 20, there is less chance of voids being formed in the fiber reinforced material after the melted material has infiltrated the preform 20.

When the aluminum in the crucible 14 is melted, the crucible lifter 40 is activated causing the crucible 14 to be moved in fluidic connection with the snorkel 30 fluidically isolating the interior of the mold chamber from direct communication with the vessel interior such that the melted aluminum in the crucible 14 can be drawn up to the mold chamber 18 through the snorkel 30 under the action of the vacuum pump, as shown in FIGS. 6 and 7. At the same time, the vessel pressurization is started with nitrogen gas to assist in forcing the aluminum into the feeder tube. As the vacuum pump 23 continues to draw fluid out of the vessel 12, the melted aluminum is drawn up through the feeder tube 38 into the mold chamber 18 where it surrounds the fiber array preform 20 and comes into contact with the water cooled head in the snorkel 30, a solidification plug is formed.

Once the melted aluminum has filled the mold chamber 18 as much as possible under the action of the vacuum pump 23, the pressure pump 25 pumps nitrogen gas into the vessel 12, as shown in FIG. 8. The pressure in the vessel 12 is consequently increased throughout the vessel 12 and specifically at the surface of the melted aluminum in the crucible 14. As the melted aluminum in the crucible 14 prevents the pressurized gas in the vessel 12 from entering the feeder tube 38 and reaching the mold chamber 18 since the interior of the mold chamber 18 is fluidically isolated from direct communication with the interior of the pressure vessel, a pressure differential is created between the interior of the vessel 12 and the interior of the mold chamber 18. This pressure differential results in the melted aluminum being forced up through the feeder tube 38 and, into the mold chamber 18, as shown in FIG. 9. The amount of melted aluminum that is forced into the mold chamber 18 and consequently the fiber array preform 20 corresponds to the amount of pressure in the vessel 12 at the surface 48 of the melted aluminum in the crucible 14. The more pressure in the vessel, the more fluid is forced into the mold chamber 18 and fiber array preform 20 to compensate for the difference in the pressure between the inside of the preform chamber 20 and the inside of the vessel 12, as shown in FIG. 9. As the aluminum is forced into the fiber array preform 20, the pressure is equalized between the inside of the fiber array preform 20 and the inside of the vessel 12 itself. By controlling the pressurization rate, it is possible to control the difference between the pressure on the inside and outside of the fiber array preform 20. The slower the rate, the lower the pressure exerted on the outside of the mold and so a thinner or lower strength wall thereof is required. Quick pressurization rates require heavy walls to withstand the pressures exerted on the walls of the mold chamber.

Figure 12:
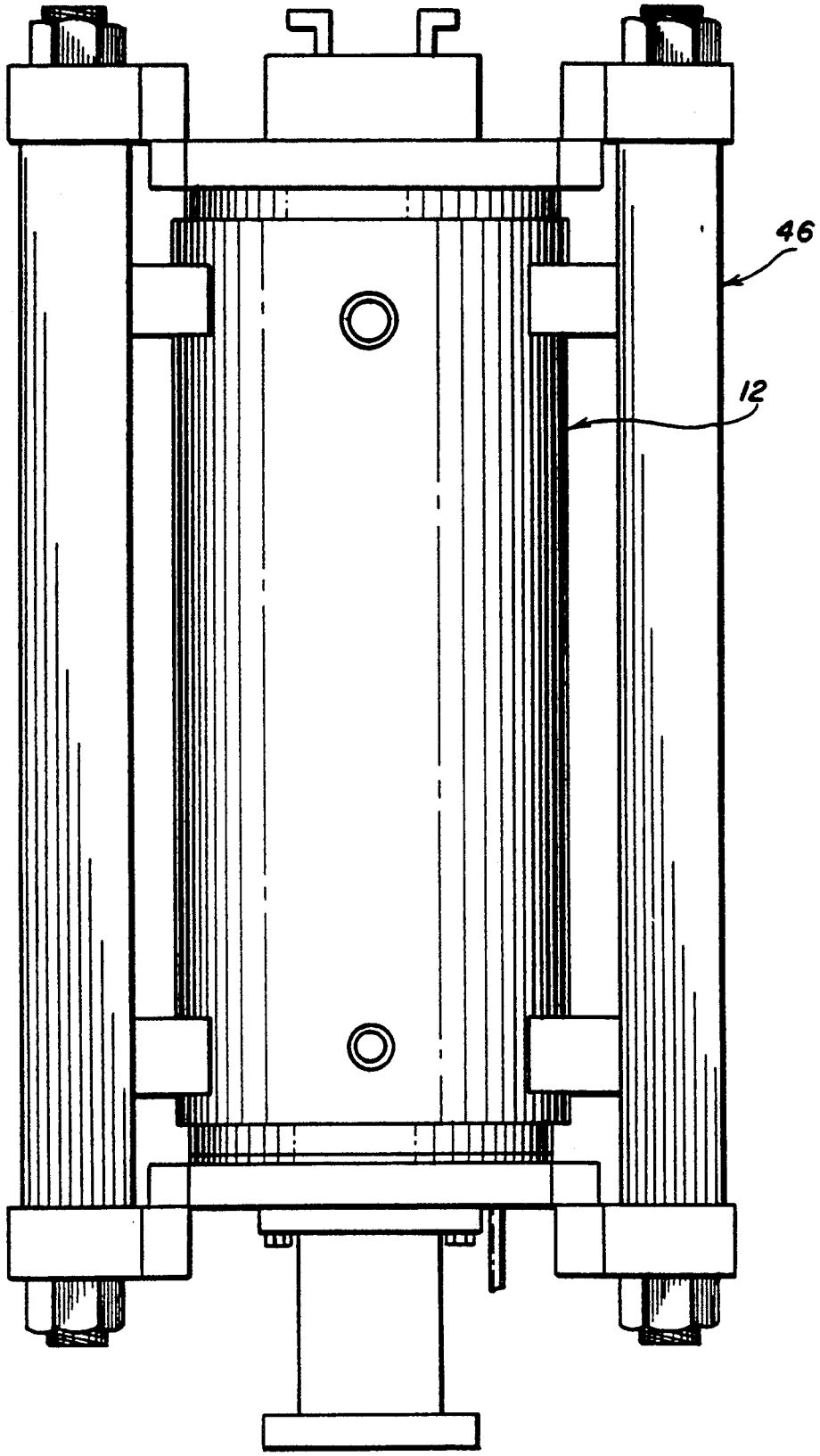
FIG. 12 is a side view of the apparatus for casting wherein a support frame holds the vessel with quick release heads.

As the melted aluminum fills the fiber array preform 20, the melted aluminum is also forced into the snorkel 30. When the melted aluminum reaches the top of the snorkel, the water cooled head 34 causes the melted aluminum in the snorkel 30 nearest the water cooled head 34 to solidify. This solidification of the melted aluminum forms the solidification plug. This solidification of the melted aluminum propagates as a wave down from the solidification plug, fiber array preform 20 and to the crucible 14, as shown in FIG. 10. The pressure pump 25 is then turned off and the mold chamber 18 with the fiber array preform 20 therein is removed from the pressure vessel 12. The vessel 12 is maintained in a support frame 46, as shown in FIG. 12, through the process.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for casting comprising the steps of:

placing a porous preform in a nonporous mold chamber of a pressure vessel;

placing a material in a crucible of the pressure vessel;

evacuating the pressure vessel through a snorkel fluidically connected to the mold chamber and extending therefrom out of the pressure vessel;

melting the material in the crucible;

placing the crucible in fluidic communication with the mold chamber such that the melted material fluidically seals the inside of the mold chamber and the snorkel from the interior of the pressure vessel to fluidically isolate the mold chamber from the interior of the pressure vessel so that a pressure differential exists therebetween; and pressurizing the vessel while the mold chamber is continuously evacuated such that the melted material is drawn into the mold chamber and into the snorkel where solidifying means in thermal communication with the snorkel cools the melted material within the snorkel thereby forming a solidification plug and the material is forced into the porous preform and the material in the mold chamber is directionally solidified from the solidification plug.

2. A method as described in claim 1 wherein the mold chamber is permanently disposed in the pressure vessel.

3. A method as described in claim 1 wherein the pressurizing step occurs at a controlled rate such that the pressure in the mold chamber is able to have time to be driven towards equilibrium with the pressure vessel therefore allowing differential pressure control between the mold chamber and the pressure vessel.

4. A method as described in claim 3 wherein the step of placing the crucible in fluidic communication with the mold chamber includes the step of lifting the crucible such that a fill tube in fluidic communication with the mold chamber is disposed within the melted material.

5. A method as described in claim 1 wherein the material is a metal.

6. A method as described in claim 5 wherein after the step of placing the porous preform in the nonporous mold chamber, the steps of evacuating the mold chamber with the porous preform disposed therein, forming a foil seal on a fill tube in fluidic communication with the mold chamber to maintain the mold chamber in an evacuated state and placing the evacuated mold chamber with the foil seal into the pressure vessel.

7. A method as described in claim 6 wherein the melting step includes the step of melting the material in the crucible with the fill tube disposed within the crucible such that the melted material melts the foil seal of the fill tube to place the mold chamber in fluidic communication with the melted material.

* * * * *